United States Patent [19]

Fuchs et al.

[11] Patent Number: 4,505,501

[45] Date of Patent: Mar. 19, 1985

[54] LATCHING DEVICE

[75] Inventors: Daniel G. Fuchs, Quincy; Larry R. Rudd, Payson, both of Ill.

[73] Assignee: The Knapheide Mfg. Co., Quincy, Ill.

[21] Appl. No.: 527,921

[22] Filed: Aug. 30, 1983

[51] Int. Cl.[3] ..... E05C 5/02

[52] U.S. Cl. ..... 292/62

[58] Field of Search ..... 292/57, 59, 62, 60, 292/63, 67, 68, 69, 114, 116, 120, 218

[56] References Cited

U.S. PATENT DOCUMENTS

| | | | |
|---|---|---|---|
| 368,595 | 8/1887 | King . | |
| 432,639 | 7/1890 | Newton . | |
| 534,987 | 3/1895 | Alsdorf . | |
| 860,769 | 7/1907 | Tait . | |
| 925,650 | 6/1909 | Raforth . | |
| 1,326,937 | 1/1920 | Kasper . | |
| 1,370,007 | 3/1921 | Davis, Jr. . | |
| 1,875,768 | 9/1932 | Smith | 292/213 X |
| 1,907,432 | 5/1933 | Mears et al. . | |
| 1,942,219 | 1/1934 | Segal . | |
| 1,950,600 | 3/1934 | De Orlow . | |
| 2,121,784 | 6/1938 | Busby . | |
| 2,749,851 | 6/1956 | Dorey . | |
| 3,298,728 | 1/1967 | Dye . | |
| 4,413,848 | 11/1983 | Leaver et al. | 292/59 |

OTHER PUBLICATIONS

Knapheide drawings (six sheets) for Steel Stake Body and Stake Rack Locks Numbers: 1. 18-06-056-6 and 18-06-065-7; 2. 18-06-234-9 and 18-06-243-0; 3. 18-0-1-015-7; 4. 18-01-013-2 and 18-01-014-0; 5. 18-01-01-2-4; 6. 18-01-011-6.

*Primary Examiner*—Richard E. Moore

*Attorney, Agent, or Firm*—Geoffrey R. Myers

[57] ABSTRACT

A latching device to connect two adjacent members (e.g. sections of a stake type truck body) is provided. The latching device is comprised of two basic members, a latching assembly and a receiving member, each attached to one of the adjacent members. The latching assembly includes a latch rod which is slidably and rotatably attached to one of the members and a spring. The spring biases the latch rod away from the receiving member. The receiving member is connected to the second member and may have a slot therein. The latch rod has an engaging end which is received within the slot and has two engaging surfaces. These two engaging surfaces firmly engage two receiving surfaces of the receiving member when the latching device is latched. One of the engaging surfaces is an approximately flat surface designed and arranged such that it forms an acute angle with a line perpendicular to the axis of rotation of the latch rod and connecting the axis of rotation of the latch rod with the center point of the engaging surface. This engaging surface abuts a similar flat surface of the receiving member when the latching device is engaged. The spring bias acts to bring these two surfaces into abutment and holds the surfaces in abutment when the latching device is latched. The engaging end also has a leading edge which is beveled starting at the longitudinal edges rising to a center ridge. This invention reduces the relative movement between the two members and, thus, reduces the vibratory noises generated by the members.

13 Claims, 10 Drawing Figures

FIG. 1
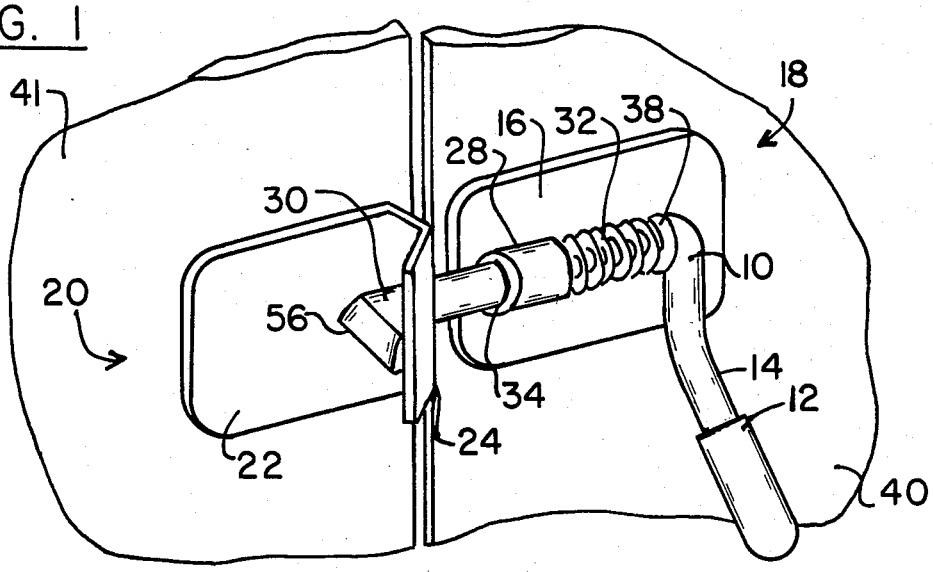
FIG. 2
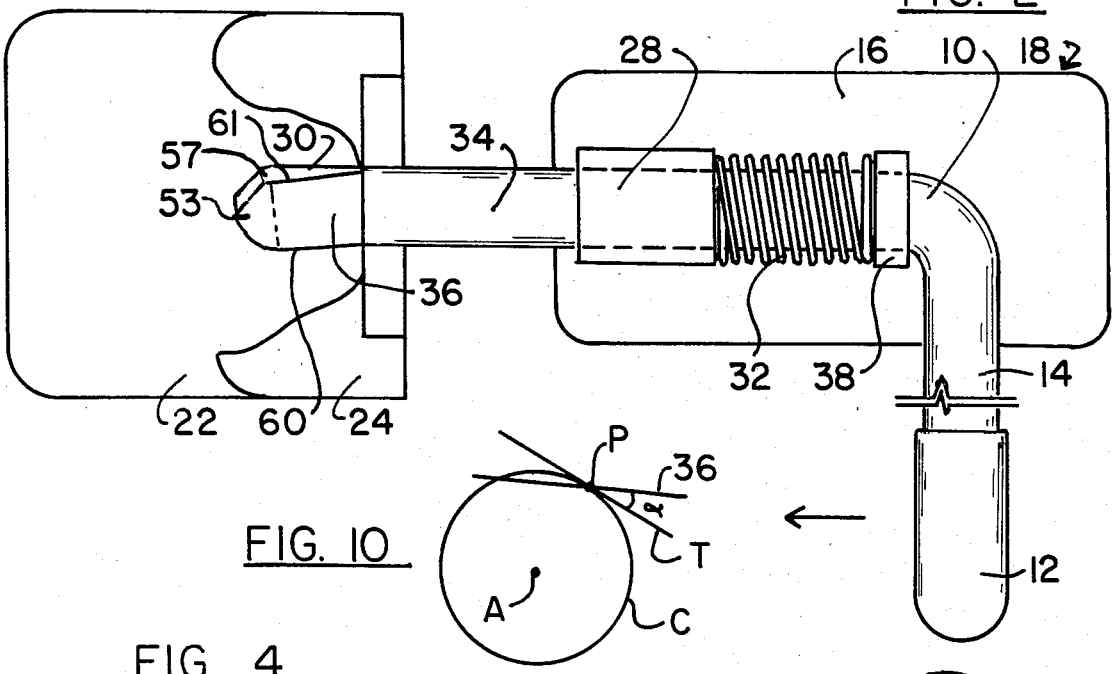
FIG. 10
FIG. 4
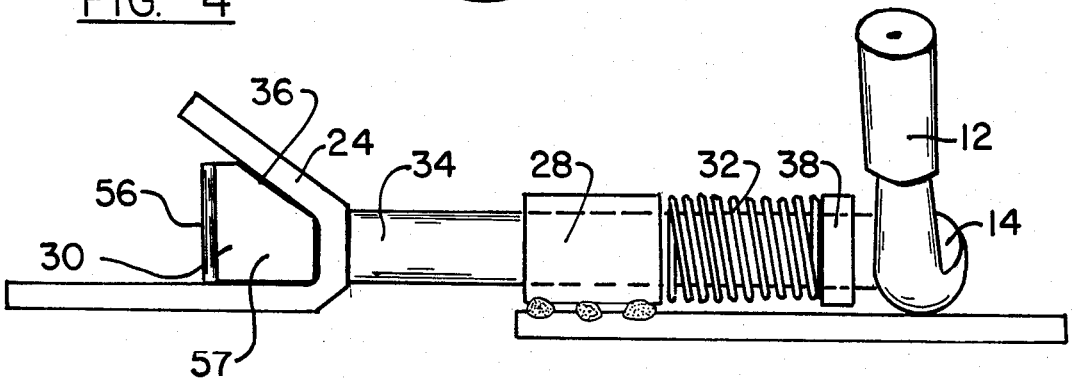

LATCHING DEVICE

This invention relates to latches for fastening two members together. In particular, this invention relates to latches having particular utility with truck stake rack bodies for securing adjacent stake rack sections together thereby preventing noise and vibration during operation, while permitting limited relative movement between the sections.

BACKGROUND OF THE INVENTION

There are many situations in which it is desired to latch two members together to prevent everything but minimal relative movement between the two members while at the same time providing that the two members can be easily unlatched when desired. One such situation, discussed in detail below as an illustration of all of these situations, is the latching of two adjacent sections of a stake rack type of truck body.

Trucks having cargo boxes comprised of removable side walls (stake rack type) are well known in the art. The truck platform usually has spaced post holes located along its periphery. The truck side wall sections have mating posts extending downward from the sections for insertion into these post holes. Because of the size of the sections and other factors, the tolerances allowed between the posts and the post holes are relatively large and the fit is not very snug. Therefore, if the sections are only secured by placing them in the post holes and are not fastened to each other, the sections will sway back and forth, vibrate, be the source of noise, and will not be very stable.

To prevent this swaying and to provide lateral support for the sections, the sections are usually fastened together after they have been installed in the proper post holes by a variety of prior art latching devices.

One such prior art latching device is illustrated in United States patent application Ser. No. 223,626, filed Jan. 9, 1981 now U.S. Pat. No. 4,413,848, issued Nov. 8, 1983 and entitled "Latching Mechanism For Panels". The latching device shown in this patent application does obtain the objectives of greatly reducing the swaying of the sections to which it is attached, as well as providing lateral support for these sections. However, in use over extended time periods, the wear characteristics and easy of operability of this latching mechanism did not maintain the desired level of performance.

All of the other known prior art fasteners have not proven capable of completely controlling the movement of adjacent body sections, due to the relatively large tolerances in the construction of the truck bodies. These large tolerances, which these prior art fasteners cannot overcome, allow the sections to move relative to each other and their supporting systems. This movement, or vibratory effect generates undesirable noise as the truck is driven down the highway.

These prior attempts at increasing the tightness of the latching or retention between the panels has at times resulted in either a too complicated or too expensive mechanism or a system which is not easily disengaged when it is desired to separate the sections. A need in the art, therefore, exists for a latching mechanism which is both effective, easy to disengage and yet reasonably uncomplicated and inexpensive.

It is a purpose of this invention to fulfill this need by providing an easily manufactured, uncomplicated latching device which securely and firmly connects adjacent members, allowing minimal movement between the members under dynamic conditions while at the same time providing an easy and reliable means for disengaging the members, thereby allowing the members to be readily separated.

SUMMARY OF THE INVENTION

Generally speaking this invention fulfills its purpose by providing a latching device for attaching first and second main members together, said latching device including a latch rod assembly attached to said first main member and a receiving member attached to said second main member, said latch rod assembly including a latch rod which is rotatably and slidably attached to the first main member and spring means for biasing said latch rod in a direction away from said receiving member, said latch rod including an engaging end which engages said receiving member when said latching device is latched, said receiving member including a first flange which projects away from said second main member, the improvement comprising: said engaging end having first and second engaging surfaces which abut first and second receiving surfaces of the receiving member when the latching device is latched, said first receiving surface being on said first flange of said receiving member and being relatively flat, said first engaging surface being relatively flat, said first engaging surface being designed and arranged such that it forms an acute angle with a line perpendicular to the axis of rotation of the latch rod and connecting the axis of rotation of the latch rod to the center point of the first engaging surface.

Some embodiments of this invention are designed and arranged to be employed on two adjacent vertical panel sections. In these embodiments, when the engaging end is engaging the receiving member, a line perpendicular to the axis of rotation of the latch rod and connecting the axis of rotation of the latch rod with the center point of the first engaging surface forms an acute angle with the horizontal plane which passes through the axis of rotation of the latch rod.

In other embodiments of this invention, the engaging end has a leading edge which is beveled towards a center ridge. The ridge runs the longitudinal direction of the leading edge.

The second receiving surface may be located on a second flange of the receiving member which can be attached to the second panel section. The second engaging surface can either be rounded or relatively flat. If the second engaging surface is relatively flat, then for optimum operability, it should be approximately parallel to the first engaging surface.

In other embodiments of this invention, the latch rod assembly may further include a latch plate attached to the first panel section, a cylinder bracket attached on a longitudinal edge to the latch plate and a coil spring which circumferentially surrounds a portion of the latch rod and has its two ends abutting the cylinder bracket and a ring located on the latch rod. The receiving member may have a slot therein through which the engaging end is passed to connect the engaging end to the receiving member.

The receiving member may be in the shape of a "J" with the first flange being the curved portion of the "J" and the second flange being the flat portion of the "J".

The engaging end is easily manipulated into and out of engagement with the receiving means. Moreover, when the engaging end is engaging the receiving member, a secure latching action is present between the two panel sections.

This latching device overcomes the problems of the prior art by allowing certain relative movement between adjacent panel sections while keeping the various parts of the latching device in contact at all times, thus greatly reducing vibration of the panel section and the latching device.

IN THE DRAWINGS

FIG. 1 is a perspective view of one embodiment of this invention, which can be employed to latch two panel sections together edge-to-edge, in the latched position.

FIG. 2 is a side view, partially cut away, of the embodiment of this invention illustrated in FIG. 1, also in the latched position.

FIG. 4 is a bottom view of the embodiment of this invention illustrated in FIGS. 1–3, also in the latched position.

FIG. 10 is a schematic drawing showing the relationship of one of the engaging surfaces to the axis of rotation of the latch rod.

DETAILED DESCRIPTION OF THE DRAWINGS

Figure 3:
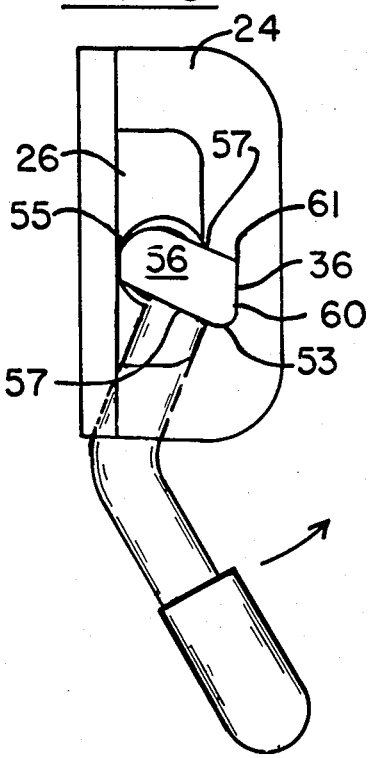
FIG. 3 is a front view of the embodiment of this invention illustrated in FIGS. 1 and 2, also in the latched position.

Referring to the Figures, in particular FIGS. 1–3, a latching device for latching together two adjacent vertical panel sections 40 and 41, arranged edge-to-edge, is provided. One use for such latching devices is in connecting two removable sections of a stake type truck body (see the discussion above). The latching device is comprised of two members, engaging member 18 and receiving member 20, attached to sections 40 and 41, respectively.

In the embodiment of this invention shown in the Figures, engaging member 18 is comprised of latch plate 16, cylinder bracket 28, latch elbow rod 10 and coil spring 32. Latch plate 16 is attached to section 40 by screws, rivets, welding or any other well-known fastening methods or devices (not shown). Cylinder bracket 28 is attached on edge lengthwise to the outer face of latch plate 16.

Latch elbow rod 10 is comprised of two legs, handle 14 and a latch rod section 34. Latch rod section 34 is slidably and rotatably received within cylinder bracket 28 and has ring 38 fixedly attached thereto. Latch rod section 34 also has engaging end 30 formed at its end thereof which is directed at and received by receiving member 20.

Spring 32 circumferentially surrounds a portion of latch rod 34 and has its ends abutting cylinder bracket 28 and ring 38. Thus, when handle 14 and ring 38 are pushed towards cylinder bracket 28 (in the direction of the arrow shown in FIG. 2), spring 32 is placed in compression and, of course, exerts a biasing force on handle 14 and ring 38 to the right (as shown in FIGS. 1 and 2).

Handle 14 has rubber grip 12 located on the end thereof to indicate to a user the optimum location of the handle to grip when operating the device and to provide a non-metallic grip for the user.

Handle 14 is also shaped as shown in the Figures to permit operation of the latching device by the palm of the user's hand. This feature is of value since under some circumstances the latching assembly will be located over the head of the user when installed on two members, for example when the latching device is employed to connect adjacent stake body panels of a truck body. The shape of handle 14 shown in the Figures enables a user under such circumstances, or similar circumstances, to more easily operate the latching device since the user can push up on rubber grip 12 with the palm of his or her hand.

Receiving means 20 is comprised, in the embodiment of this invention illustrated in the Figures, of a J-shaped member having straight flange 22 and curved flange 24. FIG. 22 abuts panel 41 and is attached thereto by any conventional fastening means such as screws, rivets, welding, etc. Flange 24 is directed away from panel 41 as shown in the Figures. Flange 24 has elongated slot 26 therein which is designed to interact with latch rod 34 as discussed below. Slot 26 is shaped such that the vertical edges thereof taper from the outside of the "J" to the inside of the "J". (See FIG. 7).

One embodiment of engaging end 30 which can be employed in the practice of this invention is illustrated in the Figures.

In this embodiment, engaging end 30 includes an engaging surface 36, beveled leading edge 56, side faces 57, bottom surface 55 and tip 53.

Engaging surface 36 begins at the end of the circular portion of latch rod 34 (also the beginning of engaging end 30) and extends up to tip 53. Upper edge 60 and lower edge 61 define the side edges of engaging surface 36. Moreover, engaging surface 36 is at an angle other than 90° with a line (perpendicular to the axis of rotation of latch rod section 34) connecting the axis of rotation of latch rod section 34 (extended) and the center point of engaging surface 36 (as viewed from the front as in FIGS. 3 and 5). In the embodiment shown in the Figures, engaging surface 36 is roughly a flat surface.

Figure 7:
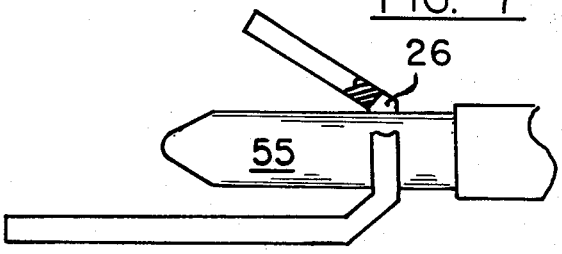
FIG. 7 is a bottom view showing the latch rod as it is being inserted into the engaging member.
Figure 8:
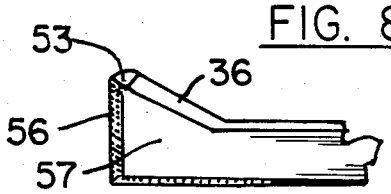
FIG. 8 is a side view of the embodiment of the engaging end of a latch rod illustrated in FIGS. 1–7.

Leading edge 56 includes two slanted surfaces of equal width located on each side of a center rounded ridge (see in FIGS. 1 and 7). These slanted surfaces can either be flat or slightly rounded, depending on the machining used to form engaging end 30. The ridge of leading edge 56 is roughly perpendicular to the axis of latch rod section 34.

In the embodiment of this invention illustrated in the Figures, bottom surface 55 is comprised of two sections, a curved section 47 (which is basically a continuation of the curvature of latch rod section 34) and a relatively flat section 48. Curved surface 47 comprises an arc of approximately 90°. Flat section 48 is roughly parallel to engaging surface 36 and runs from one end of curved surface 47 to the longest side face 57. In other embodiments, bottom surface 55 can be machined to have a different degree of curvature than latch rod section 34, can be machined to be a beveled surface with a ridge much like leading edge 56 or may be machined to be entirely an approximately flat surface. If bottom surface 55 is machined to be entirely flat, it should be roughly parallel to engaging surface 36 for optimum performance.

Side faces 57 are machined to be approximately flat so that engaging end 30 can be easily slid through slot 26 in receiving member 20. Moreover, the width of slot 26 is only slightly greater than the width of engaging end 30 to insure a tight, sure fit between engaging member 18 and receiving member 20.

Tip 53 is an approximately flat surface which is oblique with respect to engaging surface 36.

The embodiments of this invention illustrated in the Figures operate as follows. Engaging member 18 is attached to section 40 and receiving means 20 is attached to section 41 as discussed above. Sections 40 and 41 when serving, for example, as truck body panel sections, are placed in their respective post holes in the bed of the truck or attached to whatever other means is employed to keep sections 40 and 41 in the vertical, cargo carrying position. The latching device will then be in the position shown in FIG. 9.

The following steps are then taken to latch the adjacent sections 40 and 41.

Figure 5:
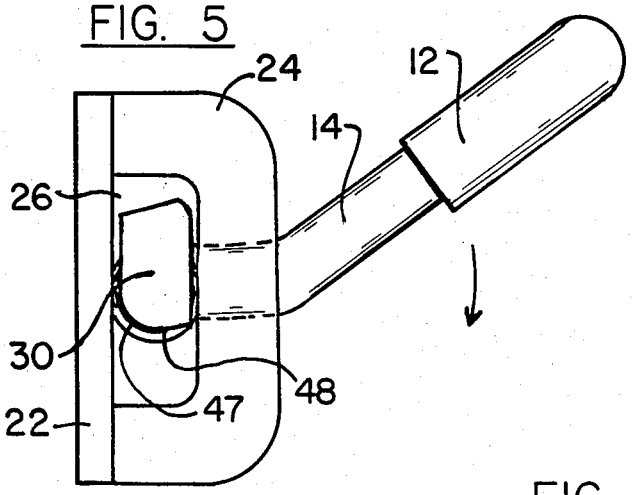
FIG. 5 is a front view of the embodiment of this invention illustrated in FIGS. 1–4, showing the engaging end being inserted into the slot of the receiving means.
Figure 6:
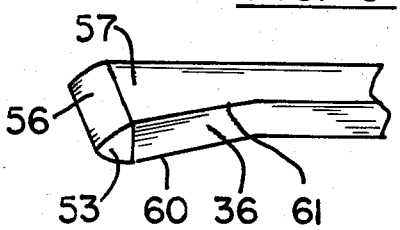
FIG. 6 is a side view of the embodiment of the engaging end illustrated in FIGS. 1–5.

First engaging end 30 is pushed through slot 26 by grasping handle 14, rotating it to the position shown in FIG. 5 and pushing handle 14 towards receiving means 20 in the direction of the arrow shown in FIG. 2 until engaging end 30 passes through slot 26.

During this movement is when the beveling of leading edge 56 is important. Since leading edge 56 is beveled outwardly towards a ridge in the center, and since the vertical edges of slot 26 are tapered inwardly (see the cutaway portion of FIG. 7), engaging end 20 is guided through slot 26 if engaging end 20 is not directly in line with slot 26 as it is pushed towards and through slot 26. Stated differently, the beveled surfaces of leading edge 56 and the tapered vertical edges of slot 26 combine to guide engaging end 20 through slot 26 if engaging end 20 is slightly out of alignment with slot 26 as engaging end 20 is pushed toward and through slot 26. This happens since, if engaging end 20 is slightly out of alignment with slot 26, one of the beveled surfaces of leading edge 56 will strike one of the vertical edges of slot 26 and continued pushing on handle 14 will cause engaging end 20 to rotate until this beveled surface clears the tapered vertical edge of slot 26.

The movement of handle 14 (and of course the entire latch elbow rod 10) as described above will be against the bias of spring 32, compressing spring 32 between cylinder bracket 28 and ring 38. Spring 32 will then exert a force on ring 38 trying to drive latch elbow rod 10 to the right as shown in FIGS. 1 and 2.

Next, once engaging end 30 has passed through slot 26 and has cleared curved flange 24, handle 14 is rotated (while still exerting a force in the direction of the arrow shown in FIG. 2) in the direction shown by the arrow in FIG. 5. When handle 14 is so rotated to the position illustrated in FIGS. 1–4, the force in the direction of the arrow shown in FIG. 2 can be released.

When this force is released, the force from spring 32 will act in the direction opposite the arrow shown in FIG. 2 and pull engaging end 30 towards cylinder bracket 28. This force will cause engaging end 30 to adjust until engaging surface 36 is abutting the inside (receiving) surface of curved flange 24, if engaging surface 36 is not already abutting this inside surface.

Once engaging surface 36 becomes in abutment with the inside receiving surface on curved flange 24, and bottom surface 55 (the second engaging surface) becomes in contact with the inside receiving surface of flange 22, the connection of engaging member 18 and receiving member 20 will have been made, and thus sections 40 and 41 will be latched together.

When this connection has been made, a line perpendicular to the axis of rotation of latch rod section 34 and extending from the axis of rotation (extended) of latch rod section 34 to the center point of engaging surface 36 will be at an acute angle with a horizontal plane passing through the same axis of rotation. Stated differently, the engaging surface 36 will be at an acute angle to the tangent plane of a cylinder (having the axis of rotation of latch elbow rod 10 as its centerline) which passes through the center point of engaging surface 36, as illustrated in FIG. 10.

In FIG. 10, the axis of rotation of latch elbow rod 10 is designated "A", the cylinder passing through the center (designated "p") of engaging surface 36 and having axis of rotation A as its centerline is designated "C" and the tangent plane to cylinder C which also passes through center P is designated "T". As clearly illustrated, tangent plane T forms an acute angle $\alpha$ with engaging surface 36. In the embodiments of this invention illustrated in the Figures, $\alpha$ is approximately 15°.

Moreover, engaging surface 36 is roughly parallel to the inside receiving surface of curved flange 24 at this time.

The employment of the latching device shown in the Figures will assure that panels 40 and 41 are firmly latched together and held relatively motionless in the lateral direction so that they do not rattle with respect to each other. Moreover, with reference to movement between sections 40 and 41 in the longitudinal direction, spring 32 will act as a shock absorber greatly limiting the motion of panels 40 and 41 with respect to each other and greatly reducing the vibratory noises resulting from any such movement.

Finally, with respect to vertical movement between sections 40 and 41, under dynamic conditions, engaging ends 20 and latch rod section 34 can move vertically relative to receiving member 20 (limited by the length of slot 26). However, before such movement can occur, the frictional force of engaging surface 36 and bottom surface 55 against receiving member 20 must be overcome. As can be seen from the Figures, it would take a relatively large force to overcome this frictional force.

Since engaging surface 36 and bottom surface 55 are at all times in contact with receiving member 20 when the latching device is in the latched position, even when sections 40 and 41 are under dynamic conditions and are moving longitudinally or vertically with respect to each other, and since the relative movement between sections 40 and 41 is minimized, the vibratory noises between sections 40 and 41 are minimized.

The design of engaging end 30 provides that it is virtually impossible for engaging member 18 to become unlatched from receiving member 20 when sections 40 and 41 are under dynamic conditions by a force tending only to rotate engaging end 30 and latch elbow rod 10. This is because the center point of mating surface 36 is located below a horizontal plane passing through the axis of rotation of latch rod section 34 when engaging end 30 is engaging receiving member 20. Any force tending to rotate engaging end 30 will act as a positive locking action and will drive edge 60 and the area of mating surface 36 proximate thereto into curved flange 24 of receiving member 20. This will, of course, prevent engaging end 30 from being easily rotated.

Furthermore, the bias of spring 32 also tends to keep latch elbow rod 10 in the locked position once engaging end 30 is fully engaging receiving member 20.

Therefore, for engaging end 30 to become inadvertently disengaged from receiving member 20 by a rotary force, once it has been engaged, the rotary force must be sufficient to drive engaging end 30 back to the left as shown in FIG. 2 so that edge 60 can swing free of curved flange 24. This would require a force of such magnitude that it would probably never be encountered in the practical use of the latching device.

Figure 9:
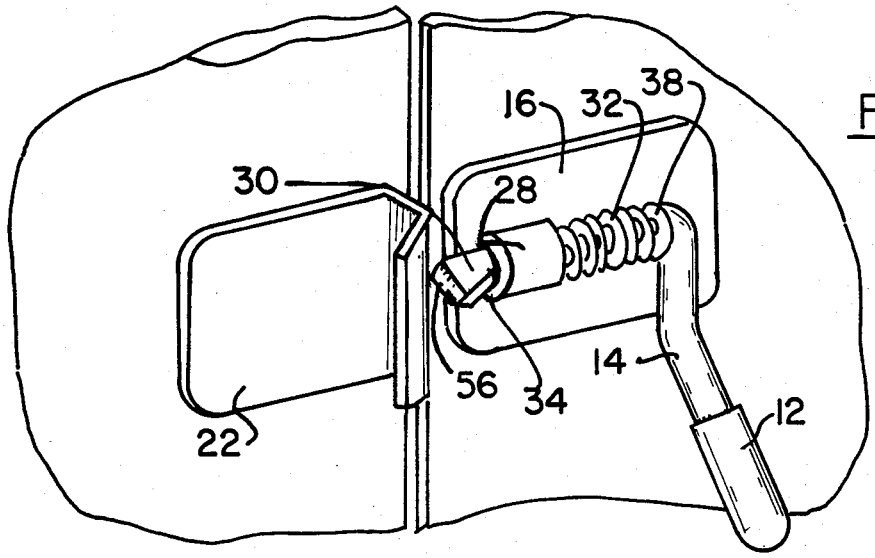
FIG. 9 is a perspective view of the embodiment of this invention illustrated in FIGS. 1–8, showing the embodiment in the unlatched position.

This embodiment of the invention can be unlatched by pushing handle 14 in the direction of the arrow shown in FIG. 2 until edge 60 clears curved flange 24, rotating handle 14 in the direction of the arrow shown in FIG. 3 until engaging end 30 reaches the position shown in FIG. 5 and letting spring 32 push latch elbow rod 10 back to the right (as shown in FIGS. 1, 2 and 9).

Devices of this type are often not finely machined. Therefore, when a surface is discussed herein as being flat or rounded, in actuality, the surface, due to rough machining may be a number of oblique surfaces which, when taken together, approximate a flat or rounded surface.

This invention can, of course, be used with components other than vertical panel sections. The above description has been limited to these sections for purposes of illustration only.

Once given the above disclosure, other modifications, embodiments and improvements will become apparent to the artisan skilled in this art. These modifications, embodiments and improvements are, therefore, considered to be within the scope of this invention as defined by the following claims:

I claim:

1. In a latching device for attaching first and second main members together, said latching device including a latch rod assembly attached to said first main member and a receiving member attached to said second main member, said latch rod assembly including a latch rod which is rotatably and slidably attached to the first main member and spring means for biasing said latch rod in a direction away from said receiving member, said latch rod including an engaging and which engages said receiving member when said latching device is latched, said receiving member including a first flange which projects away from said second main member; the improvement comprising:

said engaging end having first and second engaging surfaces which abut first and second receiving surfaces of the receiving member when the latching device is latched, said first receiving surface being on said first flange of said receiving member and being relatively flat, said first engaging surface being relatively flat, said first engaging surface being designed and arranged such that it forms an acute angle with a line perpendicular to the axis of rotation of the latched rod and connecting the axis of rotation of the latch rod to the center point of the first engaging surface.

2. A latching device according to claim 1, wherein said main members are first and second vertical panel sections, said first engaging surface being designed and arranged such that a line perpendicular to the axis of rotation of the latch rod and connecting the axis of rotation of the latch rod and the center point of the first engaging surface forms an acute angle with a horizontal plane passing through the axis of rotation of said latch rod when the latch rod is fully engaging the receiving member.

3. A latching device according to claim 1, wherein said first engaging surface is at an acute angle with the tangent plane of a cylinder having the axis of rotation of the latch rod as its centerline and which passes through the center point of the first engaging surface.

4. A latching device according to claim 2, wherein the engaging end has a leading edge which is beveled to a ridge near the centerline of said leading edge, said leading edge being the face of the engaging end which is first received by the receiving member.

5. A latching device according to claim 2, wherein the receiving member includes a second flange which is attached to said second panel section, said second flange including the second receiving surface.

6. A latching device according to claim 1, wherein said latch rod assembly includes a plate attached to said first main member, a cylinder bracket attached on a longitudinal edge to said plate, said latch rod passing through said cylinder bracket, said latch rod having means for restraining said spring means thereon, wherein said spring means is a coil spring which circumferentially surrounds a portion of the latch rod and is constrained by said cylinder bracket and said restraining means, said receiving member having a slot therein through which the engaging end passes to engage the receiving member.

7. A latching device according to claim 5, wherein the receiving member is J-shaped having a slot therein and wherein said second receiving surface is flat.

8. A latching device according to claim 7, wherein the vertical edges of said slot are tapered from the outside inwardly.

9. A latching device according to claim 8, wherein said latch rod has a circular portion which is received in said cylinder bracket, said engaging end extending from the end of the circular portion to the end of the latch rod.

10. A latching device according to claim 9, wherein said first engaging surface has an upper and a lower edge, wherein when said engaging end is engaged with said receiving member, any force tending to rotate said engaging end will be resisted by one of said edges and the area of said first engaging surface proximate to the edge.

11. A latching device according to claim 4, wherein the ridge of the leading edge runs the length of said engaging end and wherein the beveled surfaces have a curvature.

12. A latching device according to claim 1, wherein said second engaging surface is rounded.

13. A latching device according to claim 1, wherein said second engaging surface is a flat surface approximately parallel to said first engaging surface.

* * * * *

UNITED STATES PATENT AND TRADEMARK OFFICE

CERTIFICATE OF CORRECTION

PATENT NO. : 4,505,501

DATED : March 19, 1985

INVENTOR(S) : Daniel G. Fuchs and Larry R. Rudd

It is certified that error appears in the above—identified patent and that said Letters Patent is hereby corrected as shown below:

Column 7, line 47: change "and" to --end--.

Signed and Sealed this

*Sixth* Day of *August 1985*

[SEAL]

*Attest:*

DONALD J. QUIGG

*Attesting Officer*

*Acting Commissioner of Patents and Trademarks*